US006992242B2

(12) United States Patent
Shirayanagi et al.

(10) Patent No.: US 6,992,242 B2
(45) Date of Patent: Jan. 31, 2006

(54) KEYBOARD MUSICAL INSTRUMENT EQUIPPED WITH AUTOMATIC TOP BOARD SPACER

(75) Inventors: Eiichi Shirayanagi, Hamamatsu (JP); Fumiyoshi Furuki, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 92 days.

(21) Appl. No.: 10/738,274

(22) Filed: Dec. 16, 2003

(65) Prior Publication Data

US 2004/0226431 A1 Nov. 18, 2004

(30) Foreign Application Priority Data

Feb. 20, 2003 (JP) ..... 2003-042096

(51) Int. Cl.
*G10C 1/00* (2006.01)

(52) U.S. Cl. ..... 84/174; 84/177

(58) Field of Classification Search ..... 84/174, 84/177, 175, 176, 178, 180, 186.1, 186.2; 361/680

See application file for complete search history.

(56) References Cited

U.S. PATENT DOCUMENTS

| | | | | |
|---|---|---|---|---|
| 1,498,955 | A * | 6/1924 | Dinsmore | 84/180 |
| 1,682,767 | A * | 9/1928 | Opelt | 84/180 |
| 1,794,816 | A * | 3/1931 | Zeltner | 84/177 |
| 2001/0047714 | A1 | 12/2001 | Arimori | |

FOREIGN PATENT DOCUMENTS

| | | | |
|---|---|---|---|
| EP | 1361564 | A2 | 11/2003 |
| EP | 1361564 | A3 | 2/2004 |
| GB | 480966 | A | 3/1938 |

* cited by examiner

*Primary Examiner*—David Martin
*Assistant Examiner*—Jianchun Qin
(74) *Attorney, Agent, or Firm*—Morrison & Foerster, LLP

(57) ABSTRACT

A keyboard musical instrument such as a grand piano has a front top board and a rear top board with which an upper opening of a piano case is closed, and the rear top board is confronted with the front top board at the closing position; an automatic board spacer is provided between the front top board and the piano case, and automatically increases the gap after the rear top board leaves the closing position and decreases the gap at the arrival of the rear top board at the closing position, thereby preventing the user's fingers from pinch between the front and rear top boards.

22 Claims, 5 Drawing Sheets

KEYBOARD MUSICAL INSTRUMENT EQUIPPED WITH AUTOMATIC TOP BOARD SPACER

FIELD OF THE INVENTION

This invention relates to a keyboard musical instrument and, more particularly, to a keyboard musical instrument such as, for example, a piano having at least a top board confronted with another board at a closing position.

DESCRIPTION OF THE RELATED ART

Grand pianos are typical examples of the keyboard musical instrument. The grand piano includes a keyboard, action units, dampers, hammers and strings, and depressed keys give rise to rotation of the associated hammers through the action units for striking the strings. Although the keyboard is exposed to the pianist, the action units, dampers, hammers and strings are installed in a piano case, and a top board makes the upper opening of the piano case close and open. When a pianist prepares the grand piano for his or her performance, he or she lifts the side of the top board so as to expose the strings to the outside. While the pianist is playing a piece of music on the keyboard, the top board is held open so that the piano tones well reach the audience. On the other hand, when the pianist leaves the grand piano, he or she turns the top board back, and closes the upper opening. The top board prevents the action units, dampers, hammers and strings from dust and contaminants.

In the following description, term "piano case" is defined as "stationary structure except for the movable parts such as the keyboard, action units, dampers, hammers, strings, pedal mechanism and the top board". Thus, the top board is excluded from the piano case. The piano case usually includes a key bed, legs, a side board, an upper beam, key blocks, a rib, a wooden frame and a sound board. Term "front" is indicative of a position closer to the pianist, who sits on a stool for playing a tune on the keyboard, than a "rear" position. A direction between a front position and a rear position is referred to as "fore-and-aft direction", and a "lateral" direction crosses the fore-and-aft direction at right angle.

There are several sorts of the structure for the top board. A top board is split into two parts, i.e., a front top board hinged to a rear top board, and the rear top board in turn is hinged to the side portion of the side board. When a pianist prepares the grand piano for his or her performance, the pianist firstly turns the front top board over onto the rear top board, and lifts the other side of the rear top board for exposing the strings to the outside.

Another top board is also constituted by two parts, i.e., a front top board and a rear top board. However, the front top board is independent of the rear top board. The front top board may be called as "front cover board" in other models of the grand piano. A front area of the upper opening is closed with the front top board, and the rear area of the upper opening is closed with the rear top board. While the front top board and rear top board are resting on the upper surface of the side board, there remains a gap between the front top board and the rear top board. However, the gap is extremely narrow. Thus, although the plural boards serve as the top board, the inside of the piano case is well prevented from the dust and contaminants. The boards tightly brought together are desirable for the grand piano from the viewpoint of an attractive appearance.

A problem is encountered in the prior art grand piano equipped with the plural top boards in that the pianist is liable to be injured in the fingers by the top boards. In detail, when the pianist leaves the grand piano for a long time, he or she usually closes the upper opening with the top boards as already described. The pianist firstly closes the front area of the upper opening with the front top board, and, thereafter, he or she turns the rear top board back. The front top board may be stationary on the piano case. The pianist grasps the front portion of the rear top board with his or her fingers, and releases the lid prop from the lid prop cup, which is fixed to the inner surface of the rear top board. The pianist lays the lid prop down, and permits the rear top board gently to return onto the piano case with the brake on it by his or her arm. The rear top board is rotated about the hinges, and gently falls toward the side board. The front top board has already rested on the piano case, and the gap between the front top board and the rear top board is extremely narrow. When the rear top board reaches the side board, the pianist gets the fingers in the rear top board.

If he or she releases the rear top board from his or her fingers before the pinch, his or her fingers are safe from the rear top board. However, the rear top board comes down with a loud crash. The rear top board may have a flaw. In order to prevent his or her fingers from the injury and the rear top board from the crash, the pianist is to shift the rear top board from the left hand to the right hand, and clamps the rear top board at the side portion. The pianist can land the rear top board on the side board without the injury. However, the change of hand makes the pianist become tense. No one likes the work under the tension. For this reason, pianists would appreciate top boards with which they can close the upper opening without changing the manner of holding.

If the gap between the front top board and the rear top board were wide enough to receive the fingers, the pianist would put the rear top board on the side board without the injury and loud crash. However, the dust easily invades the inner space. This results in that the action units, hammers and dampers are covered with the dust. Moreover, pens or pencils may roll down into the inside of the piano case.

SUMMARY OF THE INVENTION

It is therefore an important object of the present invention to provide a keyboard musical instrument equipped with at least two top boards, with which an opening of a case is closed without any injury to fingers and contamination inside the case.

To accomplish the object, the present invention proposes to keep the gap between the top boards wide until the user brings the top board to the closed position.

In accordance with one aspect of the present invention, there is provided a keyboard musical instrument comprising a case defining an inner space open to an ambience through an opening and having a fore-and-aft direction, a tone generating system partially housed in the case and partially exposed to the ambience, a first board movably supported by the case and extending over an area of the opening so that the opening is partially closed with the first board, a second board movably supported by the case independently of the first board and changed between an open position and a closing position, and an automatic board spacer provided between the case and the first board and changing the first board between a narrow gap position and a wide gap position; the second board exposes the inner space to the ambience through a remaining area of the opening in the open position; the remaining area is closed with the second board in the closing position; the automatic board spacer keeps the first board in the narrow gap position when the second board rests at the closing position for decreasing a gap between the first board and the second board; and the automatic board spacer keeps the first board in the wide gap position after the second board leaves the closing position for increasing the gap.

BRIEF DESCRIPTION OF THE DRAWINGS

The features and advantages of the keyboard musical instrument will be more clearly understood from the following description taken in conjunction with the accompanying drawings, in which.

DESCRIPTION OF THE PREFERRED EMBODIMENTS

First Embodiment

Figure 1:
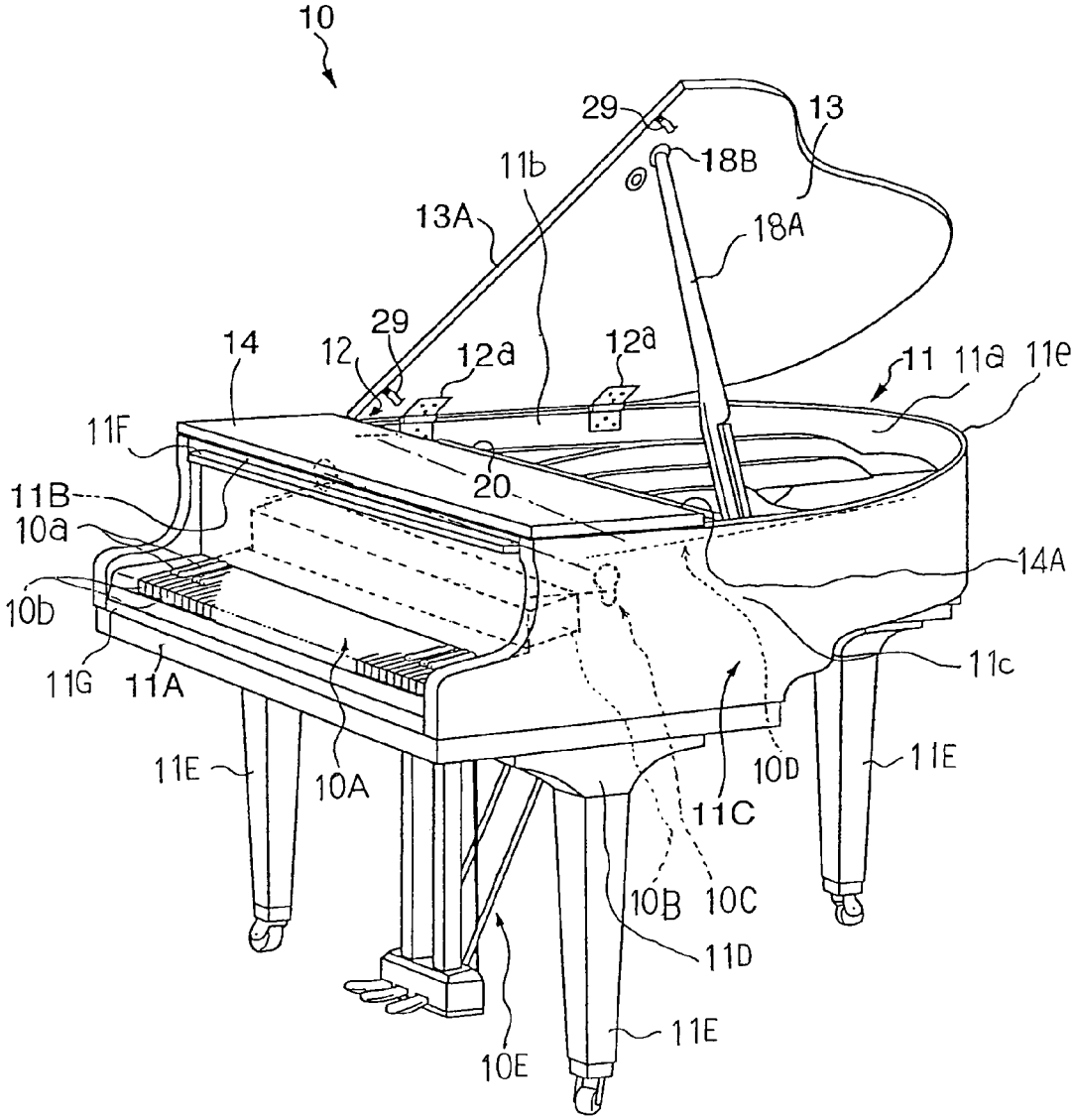
FIG. 1 is a perspective view showing the structure of a keyboard musical instrument according to the present invention.

Referring to FIG. 1 of the drawings, a keyboard musical instrument embodying the present invention largely is generally designated by reference numeral 10. The keyboard musical instrument 10 is of the grand type, and comprises a keyboard 10A, action units 10B, hammers 10C, strings 10D, dampers (not shown), pedal systems 10E, a piano case 11, an automatic board spacer 12 and top boards 13 and 14. The action units 10B, hammers 10C, strings 10D and dampers are housed in the piano case 11. On the other hand, the keyboard 10A and pedal systems 10E are partially inside of the piano case 11, and partially exposed to the outside thereof. An upper opening 11*a* is formed in the piano case 11, and is closed with the rear top board 13 and front top board 14. The automatic board spacer 12 is provided between the piano case 11 and the top boards 13 and 14, and automatically changes a gap between the front top board 14 and the rear top board 13 as will be hereinlater described in detail.

Black keys 10*a* and white keys 10*b* form in combination the keyboard 10A, and are laid on the well-known pattern. The black keys 10*a* and white keys 10*b* extend in parallel in the fore-and-aft direction, and the front portions of the black and white keys 10*a*/10*b* are exposed to a pianist who sits on a stool (not shown) in front of the grand piano 10. Thus, the piano case 11 permits the pianist selectively to depress and release the black and white keys 10*a*/10*b*.

The black and white keys 10*a* and 10*b* are linked at the rear portions thereof with the action units 10B so that the pianist gives rise to action of the associated action units 10B by depressing the black and white keys 10*a*/10*b*. The action units 10B are well-known to the skilled person, and no further description is hereinbelow incorporated for the sake of simplicity.

The black and white keys 10*a*/10B are further linked at the rearmost portions thereof to the dampers (not shown), and the pianist also automatically actuates the dampers through the black and white keys 10*a*/10*b*. While the black and white keys 10*a*/10*b* are staying at respective rest positions, the dampers are held in contact with the strings 10D, and prohibit the strings 10D from vibrations. The pianist is assumed to depress a black key 10*a* or a white key 10*b*. The depressed key 10*a*/10*b* makes the associated damper spaced from the string 10D so as to permit the string 10D to vibrate.

The hammers 10C are rotatable, and are respectively linked with the action units 10B. The hammers 10C are resting at their home positions in the inactive state of the associated action units 10B. When the pianist exerts the force on the front portion of a black/white key 10*a*/10*b*, the depressed key 10*a*/10*b* starts to sink from the rest position toward the end position, and exerts the moment on the associated action unit 10B. The action unit 10B forces the associated hammer 10C to rotate so that the hammer 10C slowly gets closer to the string 10D. Soon, the action unit 10B escapes from the hammer 10C. The hammer 10C is driven for free rotation, and strikes the associated string 10D at the end of the free rotation. The string 10D vibrates so that the acoustic piano tone is radiated from the grand piano 10.

The pedal systems 10E are linked with the keyboard 10A and dampers (not shown). In this instance, a damper pedal system, a soft pedal system and a sostenuto pedal system are incorporated in the grand piano 10, and the pianist selectively steps on the damper pedal, soft pedal and sostenuto pedal during the performance on the keyboard 10A. The damper pedal system 10E makes the acoustic piano tones prolonged, the soft pedal system 10E makes the loudness of the acoustic piano tones reduced, and the sostenuto pedal system 10E makes the particular acoustic piano tone or tones prolonged. The damper pedal system, soft pedal system and sostenuto pedal system are well known to the skilled person, and, for this reason, no further description is hereinafter incorporated.

As described hereinbefore, the keyboard 10A, action units 10B, dampers (not shown), hammers 10C, strings 10D and pedal systems 10E behave similarly to those of a standard grand piano, and description is hereinafter focused on the piano case 11, top boards 13/14 and automatic board spacer 12.

The piano case 11 includes a key bed 11A, a front board 11B, a side board 11C, leg blocks 11D and legs 11E. Although other boards such as, for example, a bottom beam, a wooden frame, a sound board, a pin block and a plate form other parts of the piano case 11, some of them are not seen in FIG. 1, and the other parts are not labeled with any reference numeral in the drawings.

The legs 11E keep the key bed 11A horizontal on a floor, and the keyboard 10A is mounted on the front portion of the key bed 11A. The side board 11C is vertical to the key bed 11A, and rearward project from the key bed 11A like a wing. The side board 11C offers a left wall portion 11*b*, a right wall portion 11*c* and a rear wall portion 11*e*, and defines an inner space together with the front board 11B, key bed 11A and etc. The inner space is open to the environment through an upper opening 11*a*, and the action units 10B, hammers 10C, strings 11E and dampers occupy the inner space. A fall board 11F is rotatably supported by the left wall portion 11*b* and the right side wall portion 11*c*. When the fall board 11F is raised, the front portions of the black and white keys

10*a*/10*b* are exposed to the pianist. On the other hand, when the fall board 11F is fallen onto a key slip 11G, the keyboard 10A is covered with the fall board 11F.

The inner space is imaginarily divided into a front zone and a rear zone, and, accordingly, the upper opening 11*a* is divided into a front area and a rear area. The rear top board 13 is swingably connected to the left wall portion 11*b* by means of a pair of top board hinges 12*a*, and the rear zone is closed with the rear top board 13. On the other hand, the front top board 14 is supported on the piano case 11 by means of the automatic board spacer 12, and the front zone is closed with the front top board 14.

A lid prop 18A is hinged to the right wall portion 11*c*, and lid prop cups 18B are secured to the reverse surface of the rear top board 13. While the lid prop 18A is lying inside the piano case 11, nothing sustains the rear top board 13 except the top board hinges 12*a*, which are provided between the rear top board 13 and the side board 11C, and the rear top board 13 is held in contact with the side board 11C in so far as the pianist does not lend the rear top board 13 his or her hand. When the pianist prepares the grand piano 10 for his or her performance, he or she opens the rear top board 13, and exposes the strings 10D to the outside. First, the pianist lifts the right side of the rear top board 13, and raises the lid prop 18A. The pianist aligns the tip of the lid prop 17 with the lid prop cup 18B, and couples the tip with the lid prop cup 18B. Then, the lid prop 18A sustains the rear top board 13, and keeps the upper opening 11*a* open. Thus, the rear top board 13 is independent of the front top board 14. In the following description, when the lip prop 18A sustains the rear top board 13, the rear top board 13 rests at the "open position". On the other hand, when the side board 11C sustains the rear top board 13, the rear top board 13 rests at the "closing position".

The front top board 14 and rear top board 13 are expected to be tight on the piano case 11 at the closing position. On the other hand, when the pianist raises the rear top board 13, the pianist appreciates the front and rear top boards 14/14 spaced from each other in the vicinity of the closing position. In order to fulfill these requests, the automatic board spacer 12 is provided between the piano case 11 and the front top board 14.

Figure 2:
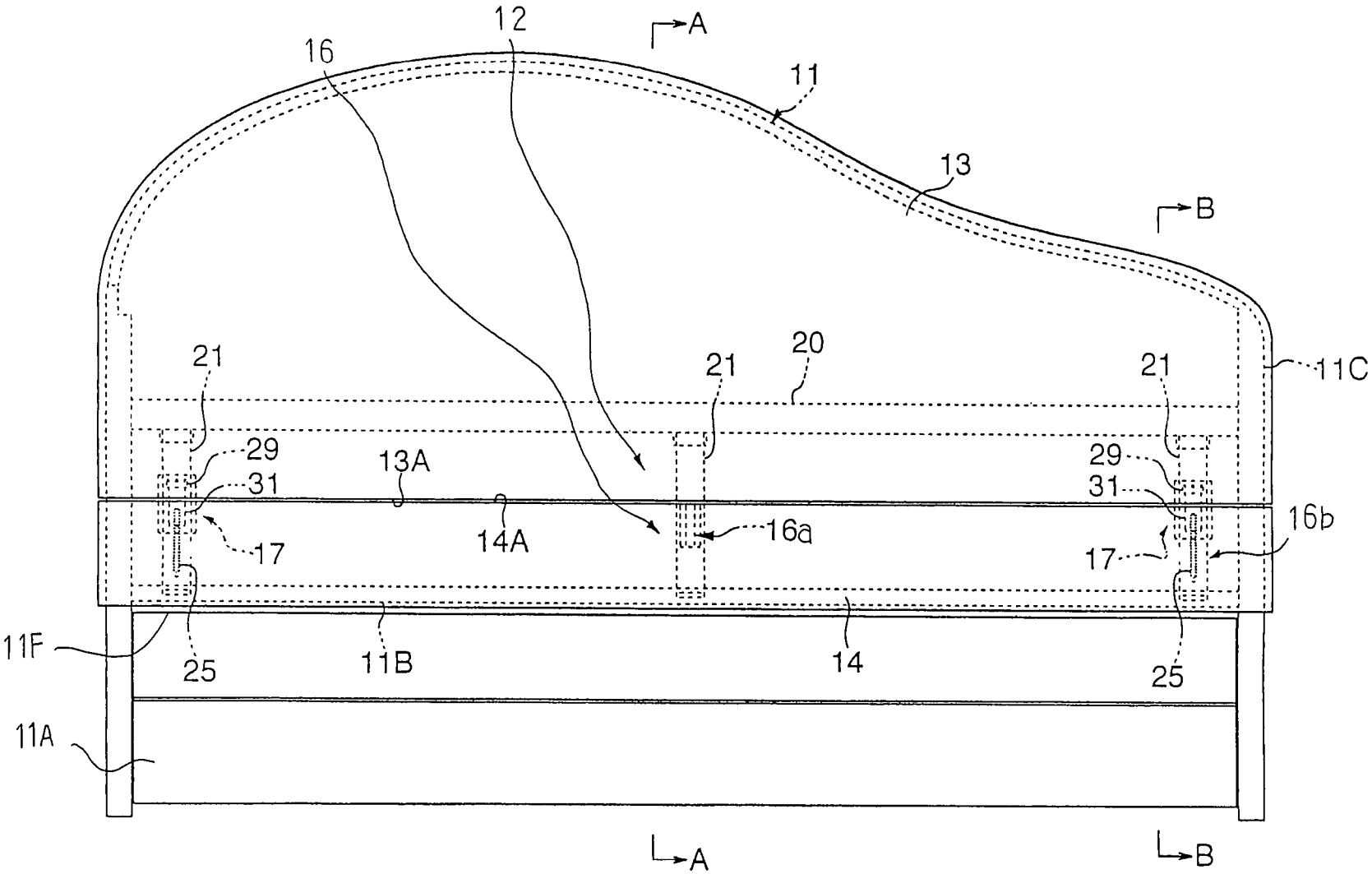
FIG. 2 is a plane view showing front and rear top boards resting on a piano case incorporated in the keyboard musical instrument.
Figure 3:
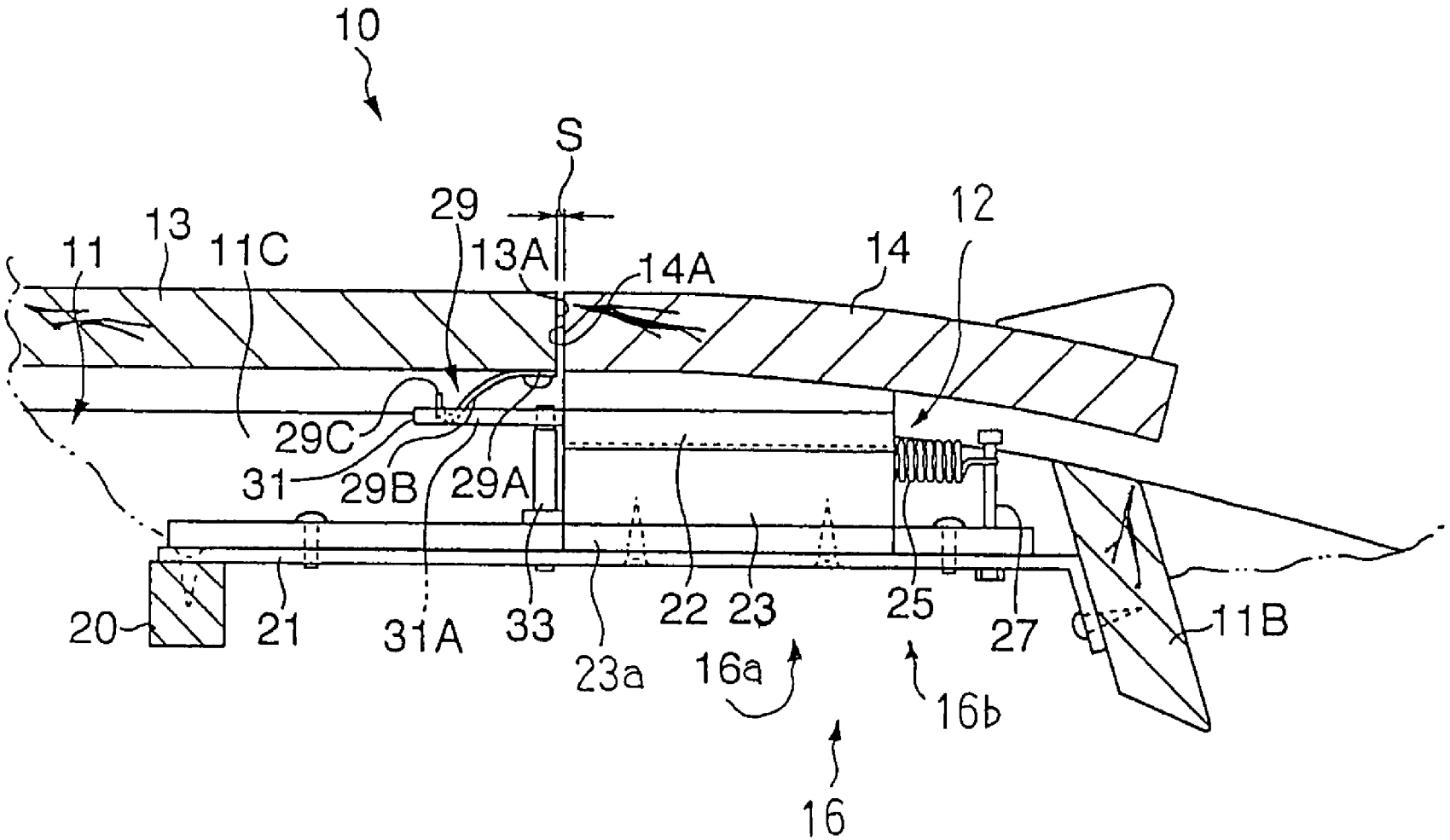
FIG. 3 is a cross sectional view taken along line A—A of FIG. 2 and showing the structure of a guide forming a part of an automatic board spacer incorporated in the keyboard musical instrument.
Figure 4A:
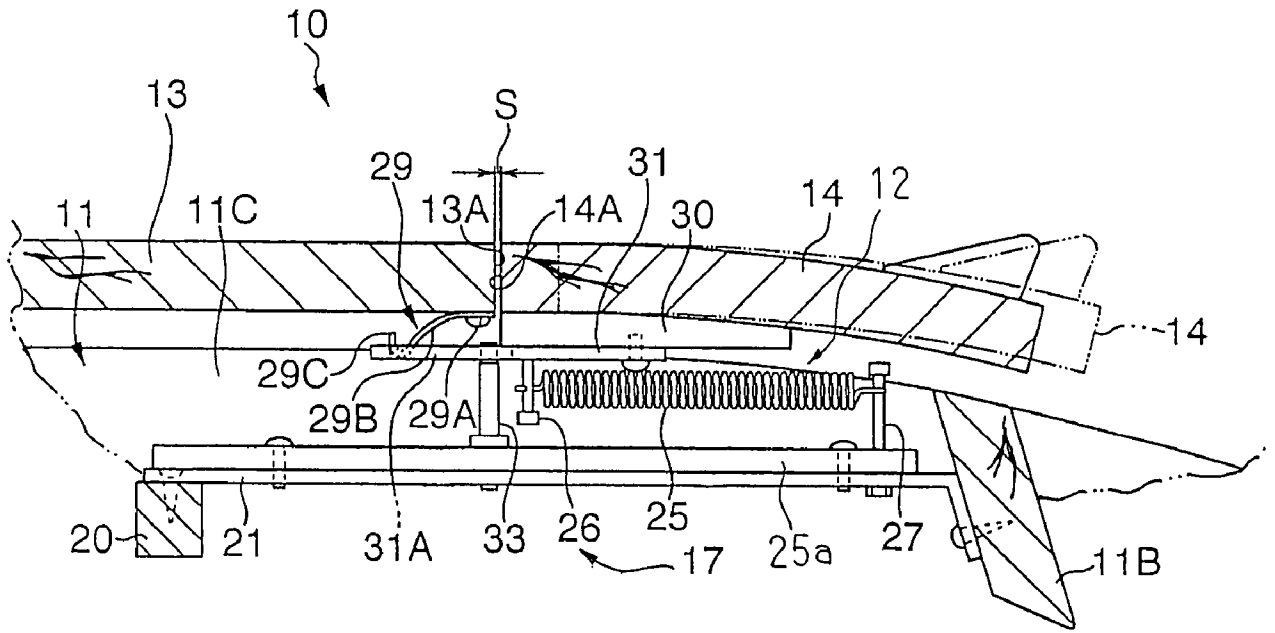
FIG. 4A is a cross sectional view taken along line B—B of FIG. 2 and showing the structure of a gap closer forming another part of the automatic board spacer.

FIGS. 2, 3 and 4A show the automatic board spacer 12. When a user slightly floats the rear top board 13, the automatic board spacer 12 moves the front top board 14 in the forward direction, and automatically increases the gap S between the rear top board 13 and the front top board 14. The automatic board spacer 12 keeps the gap wide. While the user is closing the upper opening with the rear top board 13, the automatic board spacer 12 keeps the gap S wide, and prevents the user's fingers from the pinch. However, when the rear top board 13 returns to the closing position, the automatic board spacer 12 allows the user to decrease the gap S between the front top board 14 and the rear top board 14. In detail, when the rear top board 13 reaches the closing position, the user rearward pushes the automatic board spacer 12, and allows the user to decrease the gap S. However, the automatic board spacer 12 keeps the gap S wide until closing position. Thus, the automatic board spacer 12 prevents the user's fingers from the pinch between the rear top board 13 and the front top board 14.

Figure 5:
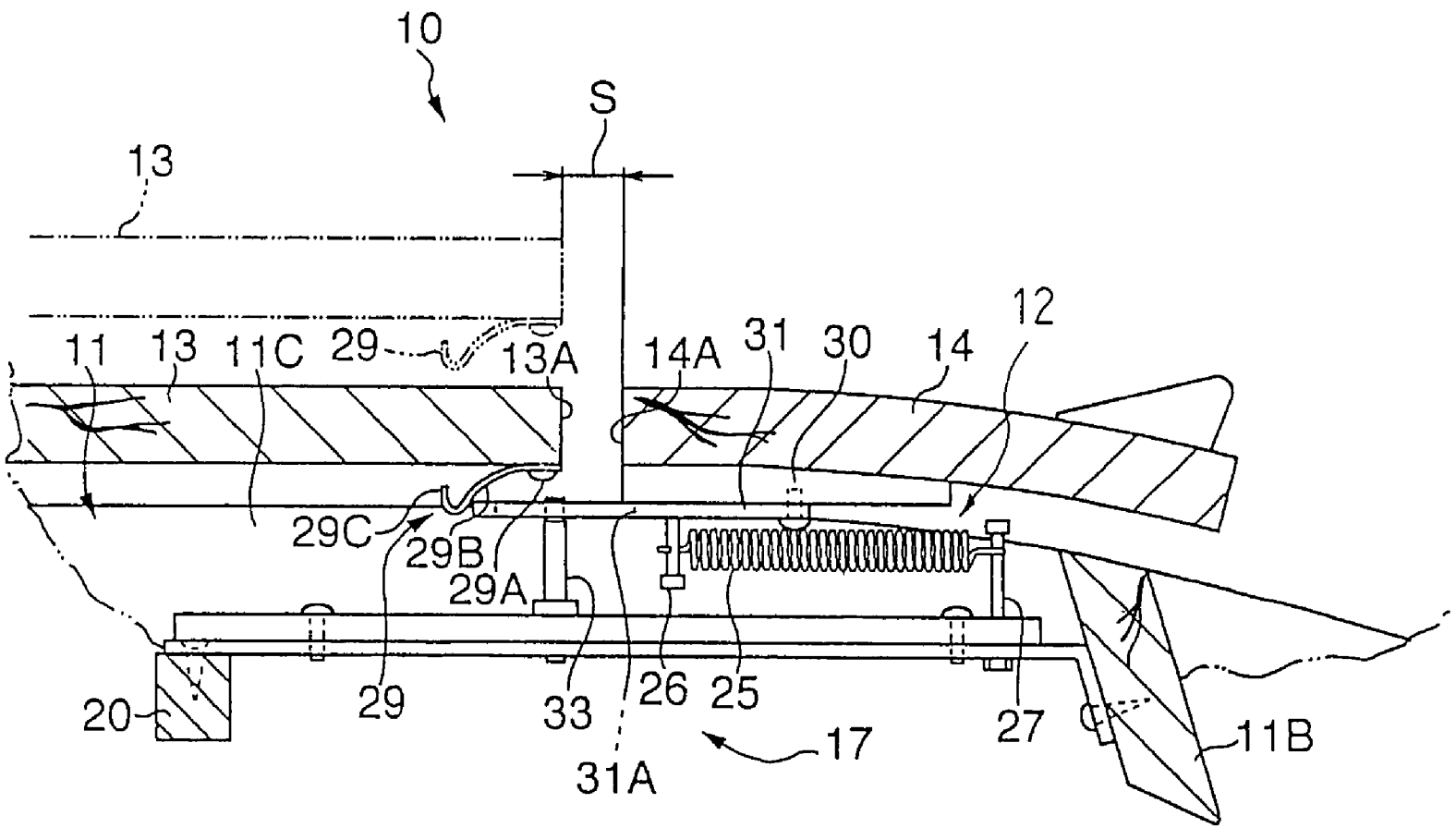
FIG. 5 is a cross sectional view showing the behavior of the gap closer.

The automatic board spacer 12 is broken down into a board actuator 16 and a stopper 17. The board actuator 16 is connected between the piano case 11 and the front top board 14, and frontward moves the front top board 14 with respect to the piano case 11. Since the stopper 17 sets a limit to the front top board 14 in the frontward motion, the front top board 14 stops at a wide gap position, and the stopper 17 keeps the front top board 14 thereat. The front top board 14 is rearward moved by the user, and the stopper 17 further sets another limit to the front top board 14. When the front top board 14 reaches the other limit, the stopper 17 keeps the front top board 14 at a narrow gap position. The gap S is minimum at the narrow gap position, and is maximized at the wide gap position (see FIG. 5).

A user is assumed to change the rear top board 13 from the closing position to the open position. The user catches the right side portion of the rear top board 14 with his or her fingers, and lifts the right side portion. Then, the right side portion floats, and the board actuator 16 immediately starts to frontward move the front top board 14. Thus, the front top board 14 is changed to the wide gap position immediately after the user lifts the right side portion. The board actuator 16 may start to move the front top board when the front end 13A is spaced from the closing position by several millimeters. When the front top board 14 reaches the wide gap position, the gap S is so wide that the user can insert his or her fingers into the inner space through the gap S. This means that the user easily lift the rear top board 13.

When the user leaves the grand piano, he or she closes the upper opening with the front and rear top boards 13 and 14. The user catches the front end 13A with his or her fingers, and disengages the lid prop 18A from the lid prop cup 18B. The lid prop 18A is laid inside the piano case 11. The user takes down his or her arms. Then, the rear top board 13 falls together with his or her fingers. When the rear top board 13 reaches the closing position, the user releases the rear top board 13 from his or her fingers, and rearward pushes the front top board 14. Since the stopper 17 does not permit the front top board 14 to move beyond the limit, the front top board 14 is never brought into collision with the rear top board 13. For this reason, the rear top board 13 enters the closing position without any interference with the front top board 14, and is confronted with the front top board 14 through the minimum gap S on the piano case 11. The minimum gap S is much less than the thickness of the fingers, and is narrow enough to prevent the inner space from dust and contaminant.

An example of the board actuator 16 and an example of the stopper 17 will be hereinafter described in more detail. As will be seen in FIG. 2, a transverse rail 20 laterally extends over the inner space in parallel to the front board 11B, and is secured at one end thereof to the inner surface of the left wall portion 11*b* and at the other end thereof to the inner surface of the right wall portion 11*c*. Three connecting plates 21 are provided between the front board 11B and the transverse rail 20, and are secured at the front ends thereof to the front board 11B and at the rear ends thereof to the transverse rail 20 by means of bolts. One of the three connecting plates 21 is located at the center of the front board 11B and transverse rail 20, and the remaining connecting plates 21 are located in proximity to the left and right wall portions 11*b* and 11*c*.

The board actuator 16 includes a guide 16*a* and a power source 16*b*. In this instance, the combination of a slider and a guide rail 22/23 serve as the guide 16*a*, and the power source 16*b* is implemented by a pair of elastic members such as, for example, coil springs 25. The guide 16*a* is provided between the center connecting plate 21 and the front top board 14, and permits the front top board 14 to move in the fore-and-aft direction. The power source 16*b* always frontward urges the front top board 14. However, the stopper 17 sets the front limit and rear limit to the front top board 14.

Thus, the power source 16*b* frontward urges the front top board 14 toward the front limit at all times.

As shown in FIG. 3, the guide rail 23 is secured to a base plate 23*a*, which in turn is secured to the center connecting plate 21 by means of bolts, and is located under the front top board 14. The guide rail 23 is elongated in the fore-and-aft direction, and has a U-letter cross section. On the other hand, the slider 22 is secured to the reverse surface of the front top board 14, and is elongated in the fore-and-aft direction. The slider 22 has an inverted U-letter cross section or an I-letter shape. The guide rail 23 is wider than the slider 22 so that the slider 22 is slidably received in the guide rail 23. An appropriate anti-friction sheet or a linear bearing is provided between the guide rail 23 and the slider 22. Thus, the front top board 14 is slidable in the fore-and-aft direction by means of the slider 22, guide rail 23 and anti-friction sheet.

However, the gap between the guide rail 23 and the slider 22 is a little. This means that the guide rail 23 and the slider 22 do not permit the front top board 14 to move in the lateral direction. The rear top board 13 stays at the closing position, and the front top board 14 is in the narrow gap position. For this reason, the front end surface 13A of the rear top board 13 is confronted with the rear end surface 14A of the front top board 14 without physical contact therebetween in FIG. 3, and, accordingly, the gap S is minimized.

Turning back to FIG. 2 of the drawings, the coil springs 25 are provided on both sides of the guide 16*a*. Base plates 25*a* are secured to the left connecting plate 21 and right connecting plate 21, respectively, as shown in FIG. 4A. Narrow plates 31 are secured to the reverse surface of a spacing plate 30, which in turn is secured to the reverse surface of the front top board 14. The narrow plates 31 rearward project from the rear end surface 14A of the front top bard 14. The plates 31 are located over the base plates 25*a*, respectively, and are aligned therewith. Pins 26 downwardly project from the narrow plates 31, respectively, and pins 27 upwardly project from the front end portions of the base plates 25*a*, respectively. While the front top board 14 is resting at the narrow gap position, the distance between the pins 26 and the pins 27 is greater than the free length of the coil springs 25. The coil springs 25 are engaged at the front ends thereof to the pins 27 and at the rear ends thereof to the pins 26. Thus, the coil springs 25 are preliminarily stretched between the pins 26 and the pins 27, and elastically urge the front top board 14 in the front direction at all times. Thus, the coil springs 25 generate the elastic force, and cause the front top board 14 to move in the fore-and-aft direction in cooperation with the guide rail/slider 22/23.

The narrow plates 31 are essential parts of the stopper 17. The stopper 17 further includes hooks 29 and rods 33. The stopper 17 sets the limit to the stroke of the front top board 14 in the fore-and-aft direction. In other words, the stopper defines the range of the motion for the front top board 14, and determines the narrow gap position and wide gap position for the front top board 14.

Long holes 31A are formed in the narrow plates 31, respectively, and are elongated in the fore-and-aft direction. The length of the long holes 31A is greater than the difference between the maximum gap S and the minimum gap S.

Figure 4B:
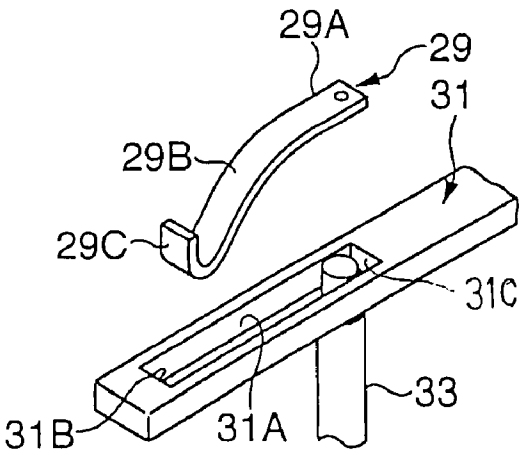
FIG. 4B is a perspective view showing a stopper forming a part of the gap closer.

The rods 33 are upright on the base plates 25*a*, respectively, and are located under the front end surface 13A. The leading end portions of the rods 33 are inserted into the long holes 31A, respectively, and permit the narrow plates 31 to move in the fore-and-aft direction. While the front top board 14 is resting at the wide gap position, the leading ends of the rods 33 are held in contact with the rear inner end surfaces 31B of the narrow plates 31. However, when the front top board 14 reaches the narrow gap portion, the rods 33 gets close to the front inner end surfaces 31C as shown in FIG. 4B. For this reason, the front top board 14 and, accordingly, the narrow plates 31 can not frontward move over the rods 33. Thus, the rods 33 set the limit to the front top board 14, and define the wide gap position for the front top board 14.

The hooks 29 are bolted at boss portions 29A thereof to the reverse surface of the rear top board 13, and rearward project therefrom. The intermediate portions 29B of the hooks 29 are gently curved downwardly, and the leading end portions 29C are upwardly bent from the intermediate portions 29B, respectively. The hooks 29 are made of metal or alloy so that the intermediate portions 29B are elastically deformable.

The hooks 29 are respectively equal in radius of curvature to the long holes 31A with respect to the top board hinges 12*a*, and are aligned with the long holes 31A at the closing position. The hooks 29 are slightly narrower than the long holes 31A. For this reason, the hooks 29 are inserted into and taken out from the long holes 31A. While the rear top board 13 is staying at the open position, the hooks 29 are out of the long holes 31A, and are far from the from the long holes 31A. When the rear top board 13 reaches the closing position, the hooks 29 are received in the long holes 31A, and the elastic force of the coil springs 25 make the leading end portions 29C held in contact with the rear inner surfaces 31B. Thus, the hooks 29 keep the front top board 14 at the narrow gap position against the elastic force of the coil springs 25. When the rear top board 13 reaches the closing position, the front top board 14 may be still on the way to the narrow gap position. In this situation, the hooks 29 are brought into contact with the rear end portions of the narrow plates 31. The front top board 14 is rearward urged, and the narrow plates 31 exert the force on the intermediate portions 29B. Then, the narrow plates 31 give rise to the elastic deformation, and the leading end portions 29C run on the upper surfaces of the rear end portions. The leading end portions 29C slide on the upper surfaces, and are fallen into the long holes 31A. Thus, the elastically deformable hooks 29 permit the user untimely to close the upper opening with the rear to board 13.

A pianist is assumed to prepare the keyboard musical instrument 10 for his or her performance. The pianist catches the right side portion of the rear top board 13 with his or her fingers, and starts to lift the rear top board 13. When the rear top board 13 floats by several millimeters as indicated by dots-and-dash lines in FIG. 5, the hooks 29 are moved out of the long holes 31A, and are disengaged from the associated narrow plates 31. Then, the coil springs 25 are shrunk, and make the trust exerted through the pins 26, narrow plates 31 and spacing plate 30 on the front top board 14. The slider 22 forwardly slides on the guide rail 23, and permits the front top board 14 to be forwardly moved. When the rear inner surfaces 31B are brought into contact with the rods 33, the front top board 14 stops, and is never moved beyond the rods 33. Thus, the front top board 14 enters the wide gap position on the way from the closing position to the open position. When the rear top board 13 reaches the open position, the pianist raises the lid prop 18A, and engages the lip prop 18A with the lid prop cup 18B. The pianist releases his or her fingers from the rear top board 13, and the lip prop 18A and lid prop cup 18B keep the rear top board 13 open.

When the pianist leaves the keyboard musical instrument 10, he or she closes the upper opening with the rear top board 13 as follows. First, the pianist catches the front end portion 13A with his or her fingers, and slightly floats the rear top board 13. The pianist disengages the lid prop 18A from the lid prop cup 18B, and the lip prop 18A is laid inside the piano case. The pianist slowly takes down the rear top board 13. While the rear top board 13 is slowly falling down toward the closing position, the coil springs 25 keeps the front top board 14 at the wide gap position, and prevents the pianist's fingers from the pinch between the rear top board 13 and the front top board 14.

When the rear top board 13 reaches the closing position, the pianist releases the rear top board 13 from his or her fingers, and rearward pushes the front top board 14 against the elastic force of the coil springs 25. The gap S is decreased. The rear ends of the narrow plates 31 are brought into contact with the intermediate portions 29B of the associated hooks 29. The pianist further exerts the force on the front top board 14. The rear ends of the narrow plates 31 pushes the intermediate portions 29B, and cause the hooks 29 to be deformed. Then, the leading end portions 29C are upwardly moved, and slide the upper surfaces of the rear end portions of the narrow plates 31. When the front top board 14 reaches the narrow gap position, the leading end portions 29C fall into the long holes 31A, and are engaged with the rear inner surfaces 31B. The hooks 29 and narrow plates 31 keep the front top board 14 at the narrow gap position against the elastic force of the coil springs 25.

As will be appreciated from the foregoing description, the automatic board spacer 12 makes the front top board 14 spaced from the rear top board on the way to the open position, and keeps the front top board 14 spaced until the rear top board 13 returns to the closing position. Thus, the automatic board spacer 12 prevents the user's fingers from the pinch between the rear top board 13 and the front top board 14.

Moreover, the user can slowly land the rear top board 13 on the piano case 11. This means that the rear top board 13 does not come down with a loud crash. Thus, the automatic board spacer 12 prevents the rear top board from a flaw.

While both rear and front top boards 13/14 are resting on the piano case 11, the automatic board spacer 12 keeps the gap S between the rear top board 13 and the front top board 14 quite narrow so that dust and contaminants hardly penetrate into the inner space of the piano case 11.

Second Embodiment

Though now shown in the drawings, another keyboard musical instrument embodying the present invention is also equipped with an automatic board spacer. Since the keyboard musical instrument is similar to that of the first embodiment, description is focused on the automatic board spacer.

The automatic board spacer also includes a board actuator and a stopper, and the board actuator has a guide and a power source. The guide may be implemented by the combination of a pinion and a rack or the combination of a guide rail and a roller. An electric motor serves as the power source. A controller and suitable position transducers or limit switches are provided for the guide or the front and rear top boards, and serve as the stopper. The position transducers or limit switches may be arranged along the guide or the trajectories of the front/rear top boards.

When a pianist slightly lifts the rear top board, the position transducer informs the controller that the rear top board leaves the closing position. Then, the controller energizes the electric motor, and the electric motor frontward moves the front top board. When the front top board reaches the wide gap position, another position transducer informs the controller of the arrival at the wide gap position. Then, the controller removes the electric power from the electric motor, and keeps the front top board at the wide gap position. A suitable elastic member or resilient member may be provided for the front top board for surely keeping the front top board at the wide gap position.

When the pianist closes the upper opening with the rear top board, the automatic board spacer behaves as follows. While the pianist is taking down the rear top board, the automatic board spacer keeps the front top board wide. When the rear top board lands on the piano case, the position transducer informs the controller of the arrival at the closing position. Then, the controller drives the electric motor for rotation in the opposite direction, and the front top board returns to the narrow gap position. When the front top board reaches the narrow gap position, the position transducer informs the controller of the arrival, and the controller removes the electric power from the electric motor. A suitable positioner such as the hooks and narrow plates may be provided for the front top board.

The keyboard musical instrument implementing the second embodiment achieves all the advantages of the first embodiment.

Although particular embodiments of the present invention have been shown and described, it will be apparent to those skilled in the art that various changes and modifications may be made without departing from the spirit and scope of the present invention.

First, the number of component parts, configuration and material do not set any limit to the technical scope of the present invention. Only one stopper may be provided for the front top board 14, and more than two or only one coil spring may be installed inside the piano case 11.

Several sorts of upright piano have plural top boards independently moved. The present invention is applicable to these sorts of upright piano so that the grand piano does not set any limit to the technical scope of the present invention.

Another keyboard musical instrument to which the present invention appertains is a mute piano. The mute piano is built up on the basis of the grand piano or upright piano, and a hammer stopper and an electronic sound generating system are installed in the piano case. The hammer stopper is changed between a free position and a blocking position. While a pianist is playing a piece of music through acoustic piano tones, the mute piano keeps the hammer stopper outside of the trajectories of the hammers so that the hammers selectively strikes the strings for generating the acoustic piano tones. When the pianist wishes to play the piece of music through electronic tones, the hammer stopper is moved into the trajectories of the hammers. While the pianist is fingering the piece of music on the keyboard, the hammers are driven for rotation, and rebound on the hammer stopper before reaching the strings. Any string is not struck with the hammers, and, accordingly does not vibrate. Nevertheless, the electronic sound generating system monitors the key motion, and electronically produces the electronic tones corresponding to the acoustic piano tones to be generated. Thus, the pianist can play the piece of music on the mute piano through the acoustic piano tones or electronic tones.

Yet another keyboard musical instrument is called as "automatic player piano". The automatic player piano is also built up on the basis of the grand piano or upright piano. An automatic playing system is installed in the piano case. A controller and solenoid-operated key actuators form essential parts of the automatic playing system. The controller analyzes music data codes, which have been already supplied from a suitable information storage medium, and determines the keys and timing at which the keys start to sink through the analysis. When the time comes, the controller selectively supplies driving signals to the solenoid-operated key actuators at appropriate timing, and the solenoid-operated key actuators move the associated keys without any fingering on the keyboard so that the hammers are driven for rotation through the action units. The hammers strike the strings for generating the acoustic piano tones. Thus, the automatic player piano can perform a piece of music without any fingering of a human player. Several automatic player pianos further include recording systems, and the music data codes are produced in an original performance by the recording system.

Still another keyboard musical instrument is known as an electronic keyboard. Although the electronic keyboard is usually different in external appearance from the grand piano and upright piano, an electronic sound generating system is housed in a case, and an opening is closed with top boards in some models. The present invention appertains the top boards of these electronic keyboards. Thus, the acoustic piano, i.e., the grand piano and upright piano do not set any limit to the technical scope of the present invention.

Even if a keyboard musical instrument is equipped with only one top board and a stationary front beam or board, the automatic board spacer according to the present invention is installed in the keyboard musical instrument. The automatic board spacer is provided between the case and the front beam or board, and prevents user's fingers from the pinch between the front beam/board and the only one top board.

The transverse rail 20 and connecting plates 21 are not indispensable, because the board actuator 16 and stopper 17 may be directly supported by the piano case 11.

The slider and guide rail 22/23 does not set any limit to the technical feature of the present invention, because a link work, a combination of pinion and rack or a feed screw system is used as the guide 16*a*. The coil springs 25 also do not set any limit to the technical feature of the present invention, because an electromagnetic actuator, a hydraulic driving system or a pneumatic driving system is used as the power source 16*b*. A piece of rubber or leaf springs may be used as the power source.

The narrow plates 31, hooks 29 and rods 33 do not set any limit to the technical scope of the present invention. Suitable limit switches are available for the electromagnetic actuator, hydraulic driving system and pneumatic driving system. The narrow plates 31 formed with the long holes 31A, hooks 29 and rods 33 may be replaced with pieces of permanent magnet attached to the piano case 11 and the front top board 14.

In the embodiments described hereinbefore, the front top board slides in the fore-and-aft direction. However, the sliding motion does not set any limit to the technical scope of the present invention. The front top board may be rotated about an axis of rotation laterally extending over the inner space. In this instance, when a user lifts the rear top board, the front top board is rotated over a certain angle so as to increase the gap. On the other hand, when the rear top board returns to the closing position, the front top board is rotated in the opposite direction, and minimizes the gap.

The keyboard 10A, action units 10B, hammers 10C, dampers and strings 10D as a whole constitute a tone generating system. In case where the present invention appertains to an electric keyboard, a keyboard, key switches, a microprocessor, a working memory, a program memory, a key assignor, a waveform memory, a tone generator, a bus system, a digital-to-analog converter and a sound system form in combination the tone generating system.

The piano case 11 is an example of a "case" used in claims. The "case" may be called as a console in another sort of keyboard musical instrument such as an electric/electronic keyboard. The front top board 14 serves as a first board, and the rear top board is corresponding to a second board. The first and second boards may be differently called in another sort of keyboard musical instrument.

What is claimed is:

1. A keyboard musical instrument comprising:

a case defining an inner space open to an ambience through an opening, and having a fore-and-aft direction;

a tone generating system partially housed in said case, and partially exposed to said ambience;

a first board movably supported by said case, and extending over an area of said opening so that said opening is partially closed with said first board;

a second board movably supported by said case independently of said first board, and changed between an open position and a closing position, said second board exposing said inner space to said ambience through a remaining area of said opening in said open position, said remaining area being closed with said second board in said closing position; and an automatic board spacer provided between said case and said first board, and changing said first board between a narrow gap position and a wide gap position when said second board is changed toward said open position, said automatic board spacer keeping said first board in said narrow gap position when said second board rests in said closing position for decreasing a gap between said first board and said second board, said automatic board spacer keeping said first board in said wide gap position after said second board leaves said closing position for increasing said gap.

2. The keyboard musical instrument as set forth in claim 1, in which said gap is less than a thickness of fingers of a human player in said narrow gap position, and is greater than said thickness of said fingers in said wide gap position.

3. The keyboard musical instrument as set forth in claim 1, in which said tone generating system includes a keyboard having keys selectively depressed and released so as to be independently moved between rest positions and end positions, action units respectively linked with said keys, and selectively actuated by the depressed keys, strings vibratory for generating tones, dampers respectively linked with said keys, and selectively spaced from the associated strings by the associated keys on the way to said end positions for permitting said associated strings to vibrate and brought into contact with said associated strings by the released keys on the way to said rest positions for damping the vibrations, and hammers selectively driven for rotation by the actuated action units and striking the associated strings so as to give rise to said vibrations.

4. The keyboard musical instrument as set forth in claim 3, in which said keyboard, said action units, said strings, said dampers and said hammers are arranged in a similar manner to a grand piano.

5. The keyboard musical instrument as set forth in claim 4, in which said grand piano includes a front top board serving as said first board, a rear top board serving as said second board, a lid prop hingedly connected to said case, and a lip prop cup secured to a reverse surface of said rear top board and engaged with said lid prop for keeping said rear top board in said open position.

6. The keyboard musical instrument as set forth in claim 5, in which said gap between said front top board and said rear top board is increased to be greater than a thickness of fingers of a human player after said rear top board leaves said closing position, and is decreased to be much less than said thickness while said rear top board is resting in said closing position.

7. The keyboard musical instrument as set forth in claim 5, in which said front top board is linearly moved in said fore-and-aft direction by means of said automatic board spacer.

8. The keyboard musical instrument as set forth in claim 7, in which said automatic board spacer includes a board actuator provided between said case and said front top board and moving said front top board between said narrow gap position and said wide gap position in said fore-and-aft direction, and a stopper associated with said board actuator and defining a movable range of said front top board for stopping said front top board at said narrow gap position and at said wide gap position.

9. The keyboard musical instrument as set forth in claim 8, in which said board actuator includes a board guide provided between said case and said front top board and extending in said fore-and-aft direction so as to permit said front top board to move between said narrow gap position and said wide gap position in said fore-and-aft direction, and a power source exerting a force on said front top board so that said front top board moves along said board guide.

10. The keyboard musical instrument as set forth in claim 9, in which said board guide includes a guide secured to said case and extending in said fore-and-aft direction, and a slider secured to said front top board and sliding along said guide together with said front top board.

11. The keyboard musical instrument as set forth in claim 9, in which at least one elastic member serves as said power source, and is connected between said case and said front top board for urging said front top board to said wide gap position.

12. The keyboard musical instrument as set forth in claim 8, in which said stopper includes at least one plate formed with a long hole extending in said fore-and-aft direction and secured to said front top board, at least one pin secured to said case and partially inserted into said long hole for defining said wide gap position together with said at least one plate, and at least one hook secured to said rear top board so as to be moved into and out of said long hole and defining said narrow gap position together with said at least one plate.

13. The keyboard musical instrument as set forth in claim 12, in which said at least one hook is elastically deformable so that said plate exerts a force on said hook on the way to said narrow gap position for bringing said hook into said long hole through the deformation after said rear top board reached said closing position.

14. A keyboard musical instrument comprising:

a case defining an inner space open to an ambience through an opening, and having a fore-and-aft direction;

a tone generating system partially housed in said case, and partially exposed to said ambience;

a first board movably supported by said case, and extending over an area of said opening so that said opening is partially closed with said first board;

a second board movably supported by said case independent of said first board, and changed between an open position and a closing position, said second board exposing said inner space to said ambience through a remaining area of said opening in said open position, said remaining area being closed with said second board in said closing position; and an automatic board spacer provided between said case and said first board, and changing said first board between a narrow gap position and a wide gap position, said automatic board spacer keeping said first board in said narrow gap position when said second board rests in said closing position for decreasing a gap between said first board and said second board, said automatic board spacer keeping said first board in said wide gap position after said second board leaves said closing position for increasing said gap, wherein said automatic board spacer changes said first board between said narrow gap position and said wide gap position through linear motion in said fore-and-aft direction of said keyboard musical instrument.

15. A keyboard musical instrument comprising:

a case defining an inner space open to an ambience through an opening, and having a fore-and-aft direction;

a tone generating system partially housed in said case, and partially exposed to said ambience;

a first board movably supported by said case, and extending over an area of said opening so that said opening is partially closed with said first board;

a second board movably supported by said case independently of said first board, and changed between an open position and a closing position, said second board exposing said inner space to said ambience through a remaining area of said opening in said open position, said remaining area being closed with said second board in said closing position; and an automatic board spacer provided between said case and said first board, and changing said first board between a narrow gap position and a wide gap position, said automatic board spacer keeping said first board in said narrow gap position when said second board rests in said closing position for decreasing a gap between said first board and said second board, said automatic board spacer keeping said first board in said wide gap position after said second board leaves said closing position for increasing said gap, wherein said automatic board spacer includes a board actuator provided between said case and said first board and moving said first board between said narrow gap position and said wide gap position, and a stopper associated with said board actuator and defining a movable range of said first board for stopping said first board at said narrow gap position and at said wide gap position.

16. The keyboard musical instrument as set forth in claim 15, in which said board actuator includes a board guide provided between said case and said first board and permitting said first board to move between said narrow gap position and said wide gap position, and a power source exerting a force on said first board so that said first board moves along said board guide.

17. The keyboard musical instrument as set forth in claim 16, in which said board guide includes a guide secured to said case, and a slider secured to said first board and sliding along said guide.

18. The keyboard musical instrument as set forth in claim 16, in which at least one elastic member serves as said power source, and is connected between said case and said first board for urging said first board to said wide gap position.

19. The keyboard musical instrument as set forth in claim 15, in which said stopper includes at least one plate formed with a long hole and secured to said first board, at least one pin secured to said case and partially inserted into said long hole for defining said wide gap position together with said at least one plate, and at least one hook secured to said second board so as to be moved into and out of said long hole and defining said narrow gap position together with said at least one plate.

20. The keyboard musical instrument as set forth in claim 19, in which said at least one hook is elastically deformable so that said plate exerts a force on said hook on the way to said narrow gap position for bringing said hook into said long hole through the deformation after said second board reached said closing position.

21. The keyboard musical instrument as set forth in claim 15, in which said gap is less than a thickness of fingers of a human player under the condition that said first board and said second board are in said narrow gap position and in said closing position, respectively, and is greater than said thickness under the condition that said second board leaves said closing position.

22. A keyboard musical instrument comprising:

a case defining an inner space open to an atmosphere through an opening;

a tone generating system partially housed in said case and partially exposed to said atmosphere;

a first board supported by said case and extending over an area of said opening so that said opening is partially covered by said first board;

a second board supported by said case independently of said first board and movable between an open position and a closed position, said second board exposing said inner space to said atmosphere through a remaining area of said opening in said open position; and an automatic board spacer for moving said first board from a first position to a second position when said second board is moved toward said open position.

* * * * *